US005325639A

United States Patent [19]

Kuboyama et al.

[11] Patent Number: 5,325,639

[45] Date of Patent: Jul. 5, 1994

[54] METHOD FOR DRESSING A GRINDING WHEEL

[75] Inventors: Matao Kuboyama, Shizuoka; Shigeharu Kobayashi, Yokohama; Fukuzo Yagishita, Shizuoka, all of Japan

[73] Assignee: Fuji Seiki Machine Works, Ltd., Shizuoka, Japan

[21] Appl. No.: 25,107

[22] Filed: Mar. 2, 1993

[30] Foreign Application Priority Data

Mar. 10, 1992 [JP] Japan ..... 4-086163

[51] Int. Cl.[5] ..... B24C 1/02

[52] U.S. Cl. ..... 51/320; 51/319

[58] Field of Search ..... 51/5 D, 410, 419, 420, 51/427, 428, 436, 319, 320, 321

[56] References Cited

U.S. PATENT DOCUMENTS 4,035,962 7/1977 Ayers ..... 51/320

5,115,600 5/1992 Kataoka et al. .

FOREIGN PATENT DOCUMENTS 59-219158 12/1984 Japan .

63-278763 11/1988 Japan .

3-3772 1/1991 Japan .

OTHER PUBLICATIONS

FIG. 1 of U.S. Ser. No. 07/884,064, filed May 15, 1992, as owned by Assignee hereof.

*Primary Examiner*—Jack Lavinder

*Attorney, Agent, or Firm*—Flynn, Thiel, Boutell & Tanis

[57] ABSTRACT

A method for dressing a grinding wheel by providing a slurry of liquid and solid particles wherein the particle size is smaller than grain size of the grinding wheel and the particles are free of sharp edges, and blasting the slurry at low pressure through a blasting nozzle onto a surface of the grinding wheel to remove foreign material on the grinding wheel by impact and by cleaning action of the blasted stream.

12 Claims, 3 Drawing Sheets

METHOD FOR DRESSING A GRINDING WHEEL

FIELD OF THE INVENTION

This invention relates to a dressing method for a grinding wheel manufactured of bonded abrasive particles, especially a super-abrasive grinding wheel such as a diamond or CBN wheel, by blasting the wheel with a mixture of solid particles and liquid.

BACKGROUND OF THE INVENTION

A super-abrasive grinding wheel, especially a CBN grinding wheel which has CBN (Cubic Boron Nitride) grains, has hardness next to diamond grain and exerts high grinding efficiency in case of grinding iron and steel materials. But, this grinding wheel easily clogs while in operation, resulting in reduction of grinding efficiency and wheel vibration.

To avoid generation of such defect, the clogging must be cleared from the grinding wheel at given time intervals. It is a well known method to use blasting of solid particles and liquid on the grinding wheel for dressing or removal of clogging of the grinding wheel.

There are publicly well known methods such as disclosed in Laid-down Japanese Patent Application Sho 63(1988)-278 763 or Laid-down Japanese Patent Application Sho 59(1984)-219 158. The former method uses shot blasting on a surface of the grinding wheel. The later method blasts grinding lubricant with abrasives at pressures higher than 20 kgf/cm.cm.

The dressing methods which have been used conventionally have always used high blasting pressure. Use of high blasting pressure often causes impacting of abrasive particles on the grinding wheel which scrub too heavily against the bonding material, thus resulting in loss of abrasive grains. In these methods, if solid particles having sharp edges are used, diamond grains or CBN grains may be broken by being hit by the hard blasted particles.

The Assignee of the present invention has disclosed in Laid-down Japanese Patent application Hei 3(1991)-3772, and corresponding U.S. Pat. No. 5,115,600, that dressing by a blasting method is effective even in the case where the blasting pressure is lower and flow rate of abrasive particles is less than those used in conventional blasting operations.

In dressing the recently developed vitrified bonded grinding wheels, which new wheel is manufactured by sintering a mixture of mineral powder and abrasive particles after the materials are shaped by a mechanical press, dressing by blasting is not used because conventional blasting using high pressure causes loss of abrasive grains from the wheel and also weakens the holding power of the bonding material of the abrasive grains.

It is an object of this invention to provide a new dressing method and an apparatus which recovers cutting efficiency of the super-abrasive wheel without drop-off or loss of the grains of the grinding wheel and also without weakening the holding power of the bonding material on the abrasive grains.

To attain this object, means is provided to blast a mixture of liquid and solid particles, which particles have a particle size equal to or smaller than that of abrasive grains of the grinding wheel, especially a super-abrasive grinding wheel, and no sharp edges on their surface, to remove foreign material from said grinding wheel by impact of the particles and cleaning action of the liquid, both of which are blasted from a blasting nozzle by pressurized fluid at low pressure (i.e. at a pressure of about 2.0 to about 3.0 kgf/cm.cm.).

Said blasted particles are (1) synthetic resin particles with a density of 1.0 to 1.5 and a hardness of 3.0 to 4.0 Mohs hardness scale, (2) a type of synthetic resin which is a so-called engineering plastic, (3) the particle size of resin particles is 0.097 to 0.425 mm, and (4) the mixing rate of solid particles in the mixture of solid and liquid is preferably about 15 to about 25 volume percent.

In the case where glass beads are used in place of solid resin particles, the particle size is between 0.02 to 0.125 mm and the mixing rate of said glass beads in the mixture of solid particles and liquid is 3 to 8 volume percent of the whole mixture. Also, the glass beads are preferably finer than #200 mesh size.

The liquid which is mixed with solid particles is preferably water or water soluble lubricant having a viscosity equal to or approximately the same as that of water. The mixture of solid particles and liquid is stirred in a pressure vessel under a pressure of 2.5 to 3.5 kgf/cm.cm.

Thus, this invention offers a dressing method which uses a light dressing media such as synthetic resin particles or fine glass beads finer than #200 mesh size. In this case, agitation or stirring of such blasting media is easy because the particles do not quickly settle to the bottom, particularly when air of slightly higher pressure (in comparison to the pressure chamber) is bled up through the bottom of the pressure chamber.

The dressing apparatus comprises (1) an enclosed pressure vessel having a conical inner surface at a lower section, (2) a shut-off valve which engages the conical inner surface of the vessel, (3) a particle supply tube which supplies a given quantity of solid particles into the pressure vessel, (4) a liquid supply tube which supplies a given quantity of liquid into the pressure vessel, (5) a fluid supply tube located at the top of said vessel for supplying pressurizing fluid into said pressure vessel, (6) a mixing fluid tube which supplies pressurizing fluid to a lower part of the shut-off valve and, by supply of the fluid, the shut-off valve is pushed upward and solid particles and liquid are mixed by the supplied pressurized fluid, and (7) a slurry supply conduit which sends slurry from the pressure vessel to a blasting gun which directs a blasting stream in perpendicular direction to a rotating axis of the grinding wheel.

Next, a more detailed description of this invention shall be given. The synthetic resin particles used as the "solid particle" in this invention is not limited strictly in kind. Either thermo-setting resin or thermoplastic resin can be used, but in either case it is necessary that particles must not have keen or sharp edges or ridges, their specific density shall be in the range of 1.0 to 1.5, and their hardness on Mohs scale shall be in the range of 3.0 to 4.0.

If specific density is too small, solid particles tend to float on the surface of liquid upon mixing of solid particles and liquid, and it becomes difficult to obtain an evenly mixed condition by agitation. If the mass of solid particles becomes too small, the impact force of said solid particles becomes small, and a proper dressing action becomes difficult.

There are a few known methods of making minute particles by breaking down compounds of synthetic resin and abrasive particles after they are mixed and solidified (Laid-down Japanese Patent Applications 61(1986)-152, 61(1986)-732, 60(1985)-73, particle size of the glass beads is usually in the range of 0.125 to 0.02 mm in diameter. But, selection of particle size shall be made upon consideration of the wheel grain size and its concentration in the super-abrasive wheel. Specific density of the glass beads is heavier than that of synthetic resin, so that particle size in use would be generally smaller than that of the synthetic resin particles.

But, in a dressing operation using glass beads, no effective dressing effect occurs when the particle size of glass beads is larger than that of the wheel grain as shown in the third Example as described hereinafter.

The specific gravity of glass beads is generally 2.7 and the Mohs hardness may be somewhat more or less than about 7. The mixing ratio of glass beads to the total slurry volume is suitably 3 to 8 in volume percent, preferably 5 percent.

There are no limitations on the method and apparatus for which it can be used in blasting slurry on a super-abrasive wheel. But, the method needs an apparatus having a mechanism which can blast slurry of consistent ratio of solid particles and liquid under constant pressure. Especially, the pressure type blasting apparatus is recommendable which works with 2.5 to 3.5 kgf/cm.cm. pressure in the pressure vessel and holds slurry in said pressure vessel pressurizing it at that pressure, with the slurry being fed to the blasting gun by pressurized fluid in the vessel and blasted from the blasting gun with the pressurized fluid.

In the case where a grinding wheel which is made by bonding abrasive grains with bond material (resin material) is to be dressed, solid particles not having keen edges shall be used as blasting media so that the bond material is not abraded too heavily, and in dressing of a vitrified grinding wheel, the bond material is not heavily abraded by blasting a soft resin 59(1984)-106, and 59(1984)-926). Particles of synthetic resin mixed with such solid particles as mentioned in the above references can be used by selecting the kind and quantity of solid particles mixed with resin.

Hardness of the particles is suitable for use in a range of 3.0 to 4.0 on the Mohs hardness scale, and these are commonly called structural or engineering synthetic resins.

In the present inventive method, synthetic resin particles which have a particle diameter equal to or less than that of the grain diameter of the grinding wheel, and in the range of 0.097 to 0.425 mm diameter, are commonly used. Selection of particles by their diameter shall be determined by consideration of grain size and grain concentration of the super-abrasive grinding wheel. It is recommended to select a structural synthetic resin such as Nylon, Polyacetal, Polycarbonate, or unsaturated Polyester.

Dressing is executed by blasting a mixture of synthetic resin particles and liquid which is evenly mixed (called a slurry) on the super-abrasive grinding wheel from a blasting gun.

The amount of synthetic resin particles in the slurry shall suitably be in the range of 15 to 20 volume percent. There may be a case that the dressing effect is too low if the volume of resin particles is too little. On the other hand, too many particles in the slurry brings ineffective results. Water is commonly used as the liquid. But, water soluble grinding lubricant which has substantially equal viscosity with water may be used in dressing of some kinds of super-abrasive grinding wheels. Suitable types of water soluble lubricant are W-1 emulsion type, W-2 semitransparent emulsion type, and W-3 emulsion type defined by Japanese Industrial Standard.

In the case where glass beads are used in place of solid resin particles for this dressing method, the material. And, abrasive grains of the grinding wheel do not fall off.

After the wheel is dressed, the grinding ability of the wheel is increased, the grinding ratio of the wheel increases, and the wheel can remove more material when compared with the same kind of wheel when dressed by some other type of dressing method.

The above-described effect, resulting by use of synthetic resin particles as the solid particles, shall be more effective by preference of kind of synthetic resin particles such that their specific gravity is in the range of 1.0 to 1.5, their hardness on Mohs scale is in the range of 3.0 to 4.0, their particle diameter is in the range of 0.097 to 0.425 mm, the volume of particles in the whole mixture is in the range of 15 to 25 volume percent, and the resin is so-called engineering plastics.

Equal results, that is, the bonding material is not too heavily abraded but foreign material is assuredly removed, can be gained by this method when the solid particles are glass beads having diameters in the range of 0.125 to 0.02 mm, and a volume of particle relative to the whole mixture in the range of 3 to 8 volume percent.

Next, is a brief explanation of the function of the apparatus. Solid particles are supplied by a particle supply tube. Liquid is supplied by a liquid supply tube. Each quantity of particles and liquid is a quantity satisfying the mixing ratio of particles and liquid. Agitating air is sent to the pressure vessel from a tube for mixing at a pressure from 2.5 to 3.5 kgf/cm.cm. which is equal with or slightly higher than the pressure inside the pressure vessel. This pressurized air, as sent from the tube for mixing air, causes a small lift of the shut-off valve, and there is created a small gap between the cone-shaped inner surface of the pressure vessel and the shut-off valve. Pressurized air passes through this gap and mixes solid particles and liquid at a location above the shut-off valve, thus making a slurry. In the above instance, the pressure inside of the pressure vessel is a little bit lower than the pressure of the air coming from the tube for mixing.

After the slurry is perfectly mixed, the pressurizing air is supplied from the fluid supply tube into an upper part of the pressure vessel. The shut-off valve descends by this supply of pressurized air and contacts the conical surface of the pressure vessel and closes the gap. Supply of agitating air may be cut off if desired. Slurry is pressurized by inducement of pressurizing air from the upper part of the vessel, and sent to the blasting gun through a slurry supply tube. In the blasting gun, the slurry is blasted against the grinding wheel with compressed air through the blasting nozzle.

DETAILED DESCRIPTION

Figure 1:
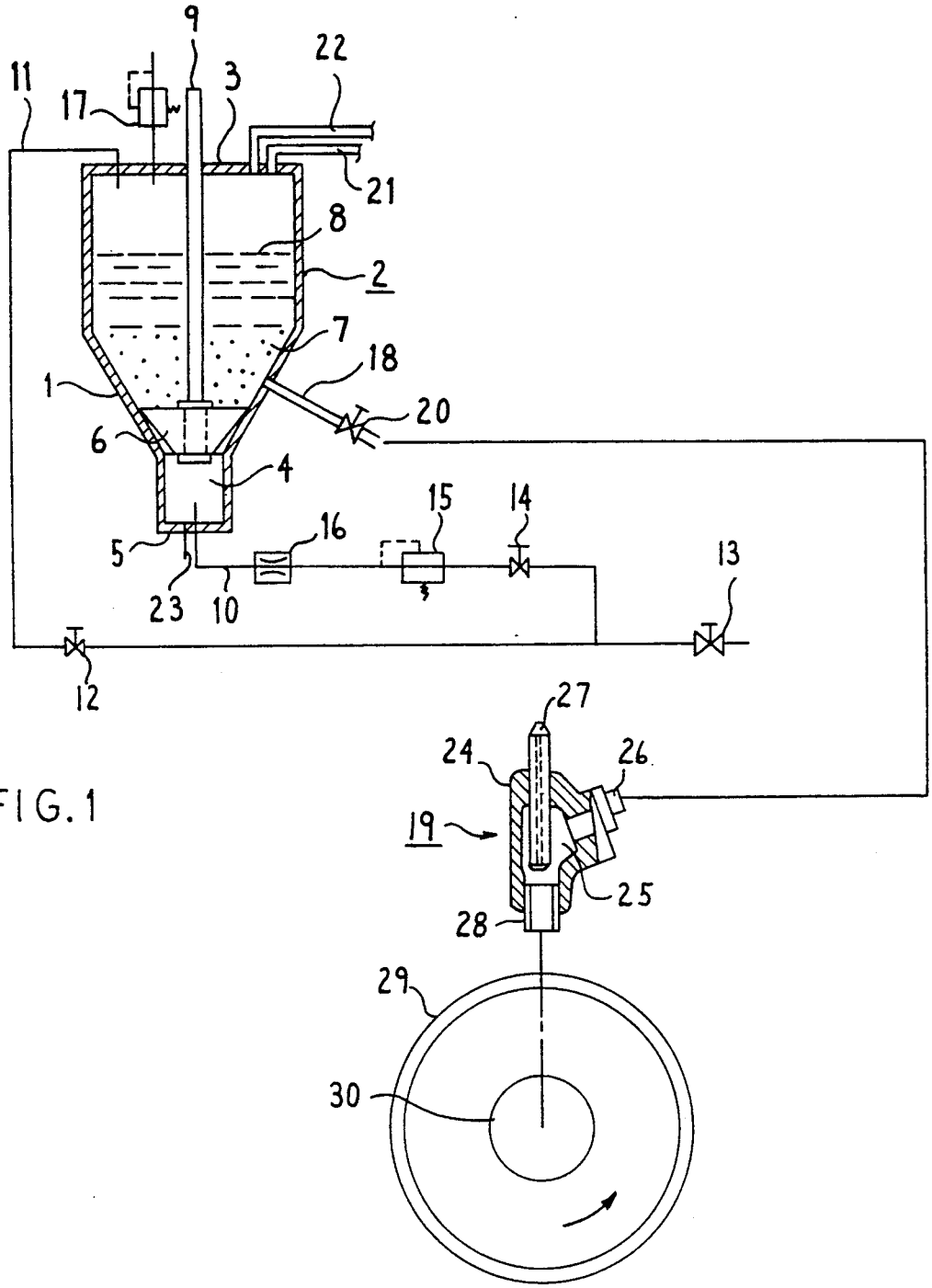
FIG. 1 is a sectional view to explain the method of the present invention.

First, an apparatus for carrying out this invention shall be described using the drawing of FIG. 1.

The closed pressure vessel 2 is shaped so that its lower part is an inverted truncated cone 1. The pressure vessel can be kept entirely closed at its upper part by the upper cover 3 and at its lower part by the bottom plate 5. The bottom plate is located downwardly from the inverted cone section 1 and is joined thereto by a small-diameter cylindrical bottom or actuating section 4 disposed therebetween. Shut-off valve body 6 shaped as an inverted frustrum or truncated cone contacts the inside of the inverted cone, thus closing the lower end of the pressure vessel. Slurry composed of liquid 8 and solid particles 7 is stored above the shut-off valve 6 within the upper chamber 31. A lower chamber 32 is defined below the valve 6 within the bottom section 4. The shut-off valve 6 can ascend and descend smoothly guided by valve rod 9 which penetrates the upper cover 3.

There are a number of pipes on the pressure vessel. A tube lo for supplying mixing air is provided and penetrates the bottom plate 5 for communication with the bottom chamber or section 4. A pressurizing air tube 11 is provided which penetrates upper cover 3 and supplies compressed air of 2.5 to 3.5 kgf/cm.cm. into the pressure vessel. A two-way valve 12 is provided in the pressurizing air tube 11 and this tube connects with a main valve 13.

The pressurizing air tube 11 breeds air into the mixing air tube 10. The mixing air tube 10 has a two-way valve 14, a pressure adjusting valve 15, and a flow control valve 16 therein.

A pressure relief valve 17 is preferably provided on the tank cover to permit controlled minute leakage of pressurized air from the interior of the tank to reduce excessive pressure therein.

Slurry supply tube 18 serves to send slurry from the vessel 2 to the blasting gun 19. The slurry supply tube 18 has a shut-off valve 20 therein.

A solid particle supply tube 21 connects to the upper cover 3 so as to supply a given quantity of solid particles into the pressure vessel. A liquid supply tube 22 also connects to the top cover 3 so as to supply a given quantity of liquid into the pressure vessel. The part 23 indicates a drain pipe.

The blasting gun 19 includes (1) a slurry chamber 25 defined inside of the gun body 24, (2) a slurry inlet 26 connecting the slurry supply tube 18 to the slurry chamber 25, and (3) a jet nozzle 27 locating on the gun body 24. Compressed air flow introduced through the jet nozzle 27 into the chamber 25 causes slurry to be sucked through line 18 into the chamber 25, whereupon the mixture of slurry and air is blasted from the blasting nozzle 28 to the rotating super-abrasive grinding wheel 29 in such a way that blasted slurry is mistified and the blasting direction is perpendicular to the turning axis 30 of the grinding wheel.

Dressing of a wheel by the apparatus described above according to a first test example shall now be explained.

Synthetic resin particles of hardness 3.5 on Mohs hardness scale, of specific the jet density 1.5, and of particle size #150 are supplied into the vessel 2. The quantity of resin particles is 10 volume, percent of the slurry (i.e. the particle-liquid mixture) in the vessel 2. Then the two-way valve 12 in pressurizing tube 11 is maintained closed and the two-way valve 14 for agitating air is opened. Air pressure in the pressure vessel 2 is kept a little bit lower than the air pressure supplied from agitating air tube 10 by adjustment of the pressure reducing valve 15. Then, compressed air at about 2.0 to about 3.5 kgf/cm.cm. is supplied from the mixing tube 10 to the bottom chamber 32 of the vessel. This causes the shut-off valve 6 to raise upwardly a little bit into a partially open position due to the pressure of the compressed air in bottom chamber 32. Consequently, compressed air from bottom chamber 32 flows upwardly through the annular opening surrounding valve 6 into the upper chamber 31 to cause the synthetic resin particles 7 and water (liquid) 8 to be mixed and agitated and define a slurry.

After the slurry is sufficiently mixed, the two-way valve 12 in the line 10 is opened, and the other two-way valve 14 having already been opened may remain open. Pressurized air at a pressure of about 3.5 kgf/cm.cm. is supplied from the pressurizing tube 11 into the chamber 31 defined in upper part of the pressure vessel 2. Due to this air pressure as supplied to chamber 31, the shut-off valve 6 descends and sealingly contacts the inside surface of the cone 1, thereby closing the gap. Air volume which flows out (leaks) from the reducing valve 17 is very little, normally only if the pressure in chamber 31 exceeds a preset maximum, and does not affect the closing of the shut-off valve 6 by supply of the pressurizing air.

Then pressurized slurry is supplied from chamber 31 to the slurry chamber 25 of the blasting gun 19 by opening the two-way valve 20 of the slurry supply tube. Due to the suction force created in the slurry chamber 25 by blasting of compressed air at a low pressure of about 2.0 to about 3.5 kgf/cm.cm. from the air jet nozzle 27 into the chamber 25, slurry is mixed with the air in the chamber 25 and is then ejected from the blasting nozzle 28 onto the grinding wheel 29.

The grinding wheel used in this first test was a vitrified bonded diamond wheel (manufacturer's designation SD-325 P100 VD1). The test work piece to be ground was Silican Nitride, $Si_3N_4$, made by a hot isostatic process (HIP). In the test, the test piece shaped as a cylinder was ground by the wheel immediately after being dressed by the above-mentioned process.

Figure 2:
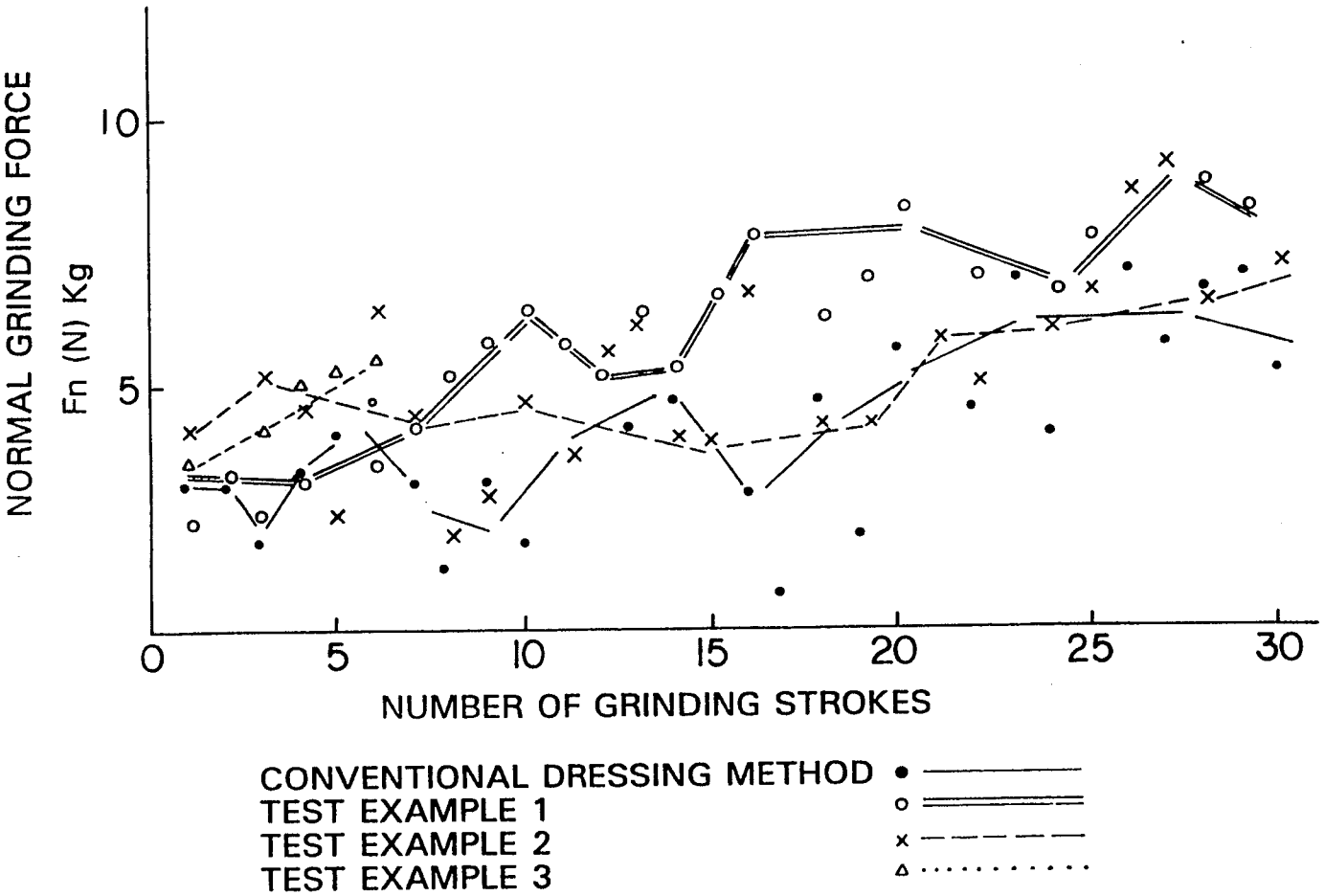
FIG. 2 is a graph showing how the grinding force along the normal line relates to the number of passes of the grinding wheel.
Figure 3:
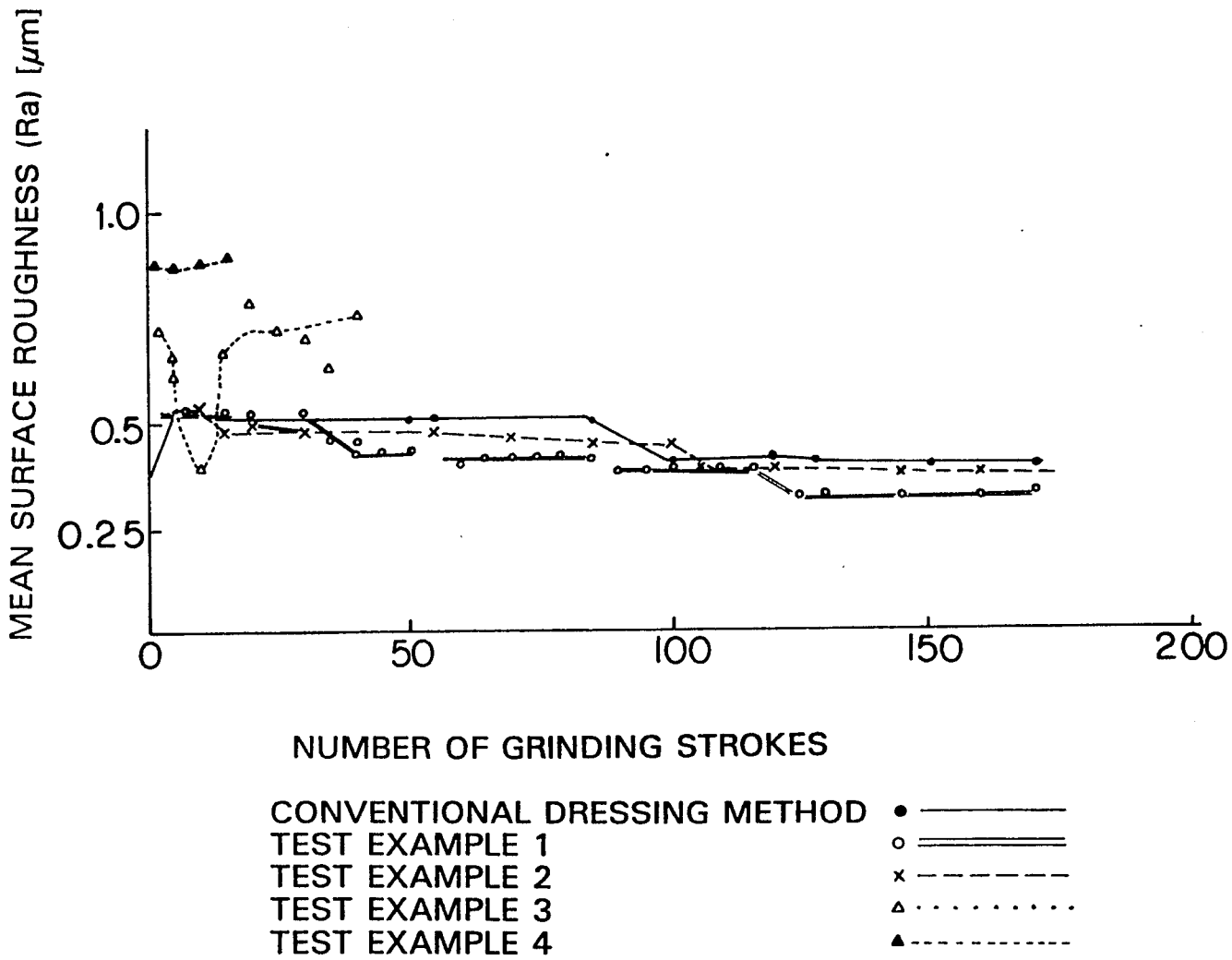
FIG. 3 is a graph showing how mean surface roughness relates to number of grinding passes.

The recorded test results relative to normal grinding force, mean surface roughness, and grinding ratio are indicated in Table 1 and on FIGS. 2 and 3.

In a second test example on dressing effect, the particles were defined by glass beads having a mean particle diameter #400 in mesh size and their mixing ratio in the whole slurry was 3 volume percent. The slurry was blasted against the grinding wheel by the same process as described above relative to the first test example. Results of this test are similar to prior results and are described in Table 1 and on FIGS. 2 and 3.

In a third test example of dressing test, glass beads of mesh size #200 were used, and good dressing effect was not obtained as shown in FIGS. 2 and 3. Also, the blasted surface of the wheel was not good.

In the apparatus of FIG. 1 as described above, the pressurizing air tube 11 can alternatively be coupled so as to communicate directly with the bottom chamber 5 as indicated by dotted line 11*a*. When using line 11*a*, the valve can be closed during blasting.

Next, the results of a conventional dressing method are shown in Table 1 and on FIGS. 2 and 3 as to compare them with the test results of the new process.

Following is a discussion of Table 1 and specifically definitions of the terms used therein.

Note 1: Grinding ratio

The measurement of grinding ratio is explained in the following paragraphs.

First, the outside diameter of the grinding wheel is measured before the grinding wheel is used for the test. At this time, a side face of the grinding wheel is partially cut to make a step on the periphery of the grinding wheel. The depth of the step in the radial direction of the wheel is measured and recorded. This step depth is indicated by "d".

After the grinding process in the test is completed, the outside diameter of the wheel and depth of the step are again measured. The difference of the step depth before and after the grinding process is designated "Δd", and the mean diameter of the wheel is computed using the diameters measured before and after the test. Thus, $$\Delta d \times \left[\begin{array}{c}\text{mean diameter of}\\ \text{the wheel}\end{array}\right] \times \text{density of the wheel} =$$

wear of the grinding wheel (in weight)

$$\text{grinding ratio} = \frac{\text{wear of the test piece}}{\text{wear of the grinding wheel}}$$

Note 2: Surface roughness

Surface roughness (=surface texture) of the test piece after grinding. This number represents the surface roughness of the test piece as measured at the end of each selected number of grinding passes (six reciprocating strokes of the grinding head is counted as one pass).

Note 3: Normal grinding force

Grinding force in a normal direction is measured at the grinding head, and increases for an increase in the number of grinding passes. The value measured at beginning and at end of the grinding process is indicated.

Note 4: Comparison data

To contrast the effect of this dressing method with a conventional dressing method, the values measured in the case of dressing by a conventional rotary dressing method are indicated in Table 1.

TABLE 1

| | | Test Example 1 | Test Example 2 | Conventional Example |
|---|---|---|---|---|
| Grinding Ratio (See Note 1) | | 379.8 | 205.6 | 116.2 |
| | Number of Passes | | | |
| Surface Roughness of finished Surface ($R_a$) (See Note 2) | 30 | 0.45 | 0.475 | 0.5 |
| | 50 | 0.40 | 0.475 | 0.5 |
| | 100 | 0.375 | 0.450 | 0.375 |
| | 150 | 0.30 | 0.375 | 0.375 |
| Grinding force in normal Direction (See Note 3) | | $4\text{–}7^N$ | $4\text{–}7^N$ | $3\text{–}5^N$ |

Vitrified diamond wheels are made by a vitrified process which is quite different from processes by which hitherto the super-abrasive wheels were made. But, the vitrified wheel can be dressed by a conventional dressing apparatus used for dressing of conventional grinding wheels. After dressing the vitrified diamond wheel by using any conventional dressing method, initial projection of the grinding force at the beginning of grinding operation is not found or apparent.

As shown by the above indicated test results, variation of both grinding force in normal direction and of surface roughness for time length of grinding operation seems to have equal tendency in two different dressing methods, namely the conventional dressing method and the present new dressing method.

But, in comparison of grinding ratio, there appears an apparent and significant difference. In the case where after the wheel was dressed by the conventional rotary dresser, the grinding ratio indicates 116.2. In the case where after the wheel was dressed by glass beads of Example 2, the grinding ratio is 205.6. In the case where after the wheel was dressed by the resin particles of Example 1, the grinding ratio is 379.8. These examples teach that by selecting a proper dressing method for the same kind of grinding wheel and grinding operation on the same material, the grinding ratio will rise to more than three times that of the other dressing method. This shows that this difference will contribute to reduction of cost of grinding wheels since wear of the wheel is one main element.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A dressing method for dressing a super-abrasive grinding wheel, comprising the steps of: providing a slurry of liquid and solid particles wherein the particle size is smaller than grain size of the grinding wheel and the particles are free of sharp edges and wherein the solid particles are synthetic resin with a specific density in the range of 1.0 to 1.5 and a Mohs scale hardness in the range of 3.0 to 4.0, and blasting the slurry at low pressure through a blasting nozzle onto a surface of the grinding wheel to remove foreign material on the grinding wheel by impact and by cleaning action of the blasted stream.

2. A method according to claim 1, in which the mixing ratio of solid particles of synthetic resin to the whole mixture of solid particles and liquid is in the range of 15 to 25 volume percent.

3. A method according to claim 1, in which the synthetic resin is of engineering plastics.

4. A method according to claim 1, in which the particles of synthetic resin have a particle diameter in the range of 0.097 to 0.425 mm.

5. A method according to claim 4, in which the mixing ratio of solid particles of synthetic resin to the whole mixture of solid particles and liquid is in the range of 15 to 25 volume percent.

6. A method according to claim 1, in which the liquid is water or a water soluble grinding lubricant having a viscosity which is equal to or near to that of water.

7. A method according to claim 1, in which the slurry mixture is held in a pressure vessel under a pressure of about 2.5 to about 3.5 kgf/cm.cm.

8. A method according to claim 1, wherein the slurry is blasted from the nozzle onto the grinding wheel at a pressure of about 2.0 to about 3.0 kgf/cm.cm.

9. A process for dressing super-abrasive grinding wheels, specifically a vitrified bonded grinding wheel, comprising the steps of: providing a quantity of small solid particles which are free of sharp exterior edges, providing a predetermined quantity of a liquid having a viscosity equal to or similar to that of water, joining the predetermined quantities of solid particles and liquid to form a mixture, injecting air into the mixture to agitate the mixture of create a slurry, maintaining the slurry in a closed pressure vessel at a pressure in the range of from about 2.5 to about 3.5 kgf/cm.cm., inducing the pressurized slurry into a slurry chamber of a blasting gun, mixing the slurry in the slurry chamber with an air blasting jet passing therethrough, and directing a slurry-air jet stream discharged from the blasting gun against the working surface of a rotating super-abrasive grinding wheel to effect removal of contaminates therefrom.

10. A process according to claim 9, wherein the solid particles are of synthetic resin having a specific density in the range of 1.0 to 1.5, a Mohs scale hardness in the range of 3.0 to 4.0, and a particle diameter in the range of 0.097 to 0.425 mm.

11. A process according to claim 10, wherein the solid synthetic resin particles define from about 15 to about 25 percent of the volume of the mixture.

12. A process according to claim 9, wherein the solid particles comprise round glass beads having a diameter in the range of 0.02 to about 0.125 mm, and wherein the glass beads define in the range of 3 to 8 percent of the total volume of the mixture.

* * * * *

UNITED STATES PATENT AND TRADEMARK OFFICE

CERTIFICATE OF CORRECTION

PATENT NO. : 5 325 639

DATED : July 5, 1994

INVENTOR(S) : Matao KUBOYAMA, et al

It is certified that error appears in the above-indentified patent and that said Letters Patent is hereby corrected as shown below:

Column 9, line 9; change "mixture of create" to ---mixture and create---.

Signed and Sealed this

Eighth Day of November, 1994

Bruce Lehman

*Attest:*

BRUCE LEHMAN

*Attesting Officer*

*Commissioner of Patents and Trademarks*